United States Patent [19]

Waggett

[11] Patent Number: 4,675,631

[45] Date of Patent: Jun. 23, 1987

[54] WAVEGUIDE BANDPASS FILTER

[75] Inventor: Michael C. Waggett, Luton, United Kingdom

[73] Assignee: M/A-COM, Inc., Burlington, Mass.

[21] Appl. No.: 692,665

[22] Filed: Jan. 17, 1985

[51] Int. Cl.[4] ..... H01P 1/219; H01P 1/208; H01P 7/06

[52] U.S. Cl. ..... 333/210; 333/212; 333/226

[58] Field of Search ..... 333/208, 209, 210, 211, 333/212, 202, 248, 227–235

[56] References Cited

U.S. PATENT DOCUMENTS 2,943,280 6/1960 Brill ..... 333/208
3,819,900 6/1974 Ironfield ..... 333/209 X
3,949,327 4/1976 Chapell ..... 333/210

FOREIGN PATENT DOCUMENTS 1133801 11/1968 United Kingdom .

*Primary Examiner*—Marvin L. Nussbaum
*Attorney, Agent, or Firm*—Wolf, Greenfield & Sacks

[57] ABSTRACT

A waveguide bandpass filter having multiple waveguide sections including alternating ridge waveguide sections and evanescent waveguide sections. The ridge waveguide sections define a resonant cavity and the evanescent waveguide sections reactively load the resonant cavity thus intercoupling the ridge waveguide sections so as to provide a low loss filter having high attenuation, not only at adjacent stop band frequencies, but also at harmonics of the pass band.

12 Claims, 10 Drawing Figures

Fig.1
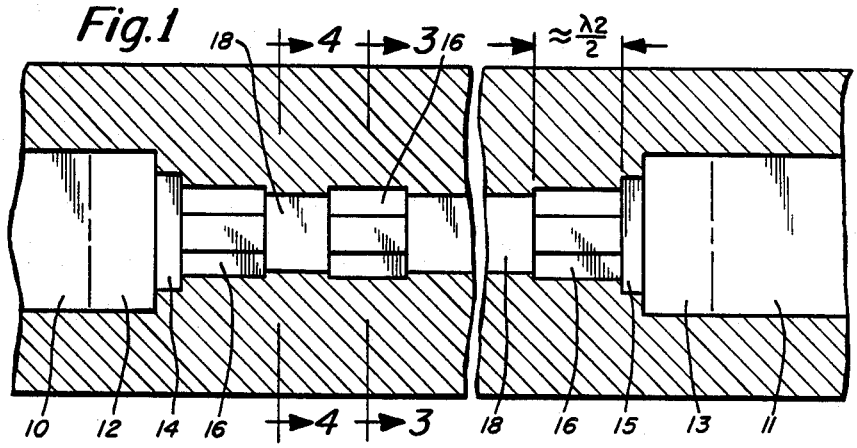
Fig.2
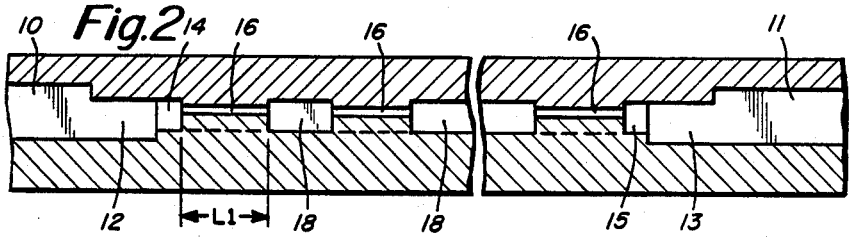
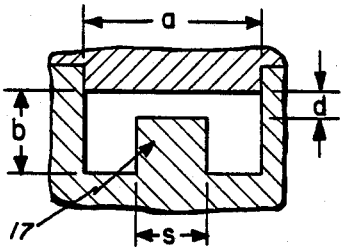
Fig.3
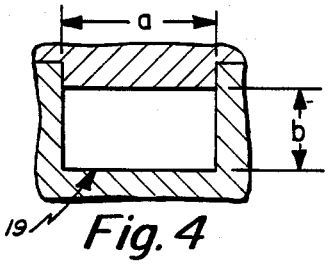
Fig.4
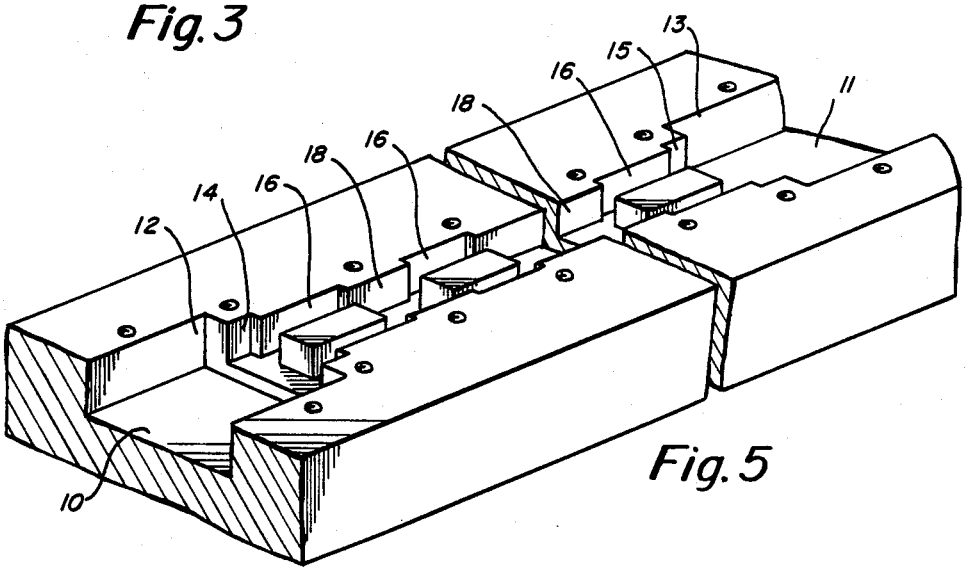
Fig.5

WAVEGUIDE BANDPASS FILTER

BACKGROUND OF THE INVENTION

The present invention relates in general to waveguide bandpass filters, and pertains, more particularly, to a low loss microwave bandpass filter having high attenuation, not only at adjacent stop band frequencies, but also at harmonics of the pass band. The filter of this invention exhibits good rejection of the second harmonic of the pass band, all incorporated in a single filter structure, thus not requiring the usual cascading of a bandpass filter and a low pass filter.

Waveguide bandpass filters may presently be considered as falling into two main categories. One filter is an iris or post-coupled filter and the other is an evanescent mode waveguide filter. In the first category, there are provided a series of tuned waveguide cavities coupled with irises or posts across the waveguide. These filters require good electrical contact between the coupling iris or post in both the top and bottom walls of the waveguide. Such filters usually use waveguide of the same cross-sectional dimension as the transmission waveguide for the band required. Cavities having a fairly high unloaded Q factor are possible, enabling low loss narrow band filters to be constructed. However, the half wavelength rectangular cavities become one wavelength resonant cavities in the HO2 mode near the second harmonic of the desired pass band. Also, most simple coupling iris structures permit the free transmission of the second harmonic in the HO2, HO3, or Eln modes. Thus, it is practically impossible to construct a bandpass filter, particularly in a standard waveguide (in a standard waveguide, the second harmonic of the required frequency has at least five different modes by which it propagates down the waveguide) which controls the second harmonic rejection, without designing a separate low pass filter and cascading the two.

The second category of present bandpass filters is the evanescent mode waveguide filter which comprises a series of evanescent waveguide sections, each resonated by capacitive elements at their section junctions. Typically, these waveguide filters are based upon a filter design having capacitive gapped posts across a reduced dimension waveguide. With these filters, the second harmonic may only be transmitted in a single (HO1) mode so that any spurious pass bands are sited away from this frequency. The resonators so constructed in this evanescent mode filter have a lower Q and their frequency is dependent on a thin gap at the end of the post. Thus, these filters are limited in use to broad band applications. The much lower Q factor of the resonant circuits formed in this way leads to high pass band loss in narrow band filters. Also, in this waveguide filter, the capacitive gaps (gapped posts) are very critical to set up and are temperature dependent.

Accordingly, it is an object of the present invention to provide an improved waveguide bandpass filter that combines low loss bandpass filter characteristics with high attenuation at harmonic frequencies.

Another object of the present invention is to provide an improved waveguide bandpass filter which is characterized by good rejection of the second harmonic of the pass band, all incorporated into a single filter structure. As indicated previously, the filter of the present invention eliminates the need for cascading filters and eliminates the need for, in particular, cascading a bandpass and low pass filter.

A further object of the present invention is to provide an improved waveguide bandpass filter that provides more predictable performance, particularly at harmonics, by reducing over-moding effects.

Still another object of the present invention is to provide an improved waveguide bandpass filter that is constructed so as to eliminate the need for employing a separate harmonic filter in association therewith.

Still another object of the present invention is to provide an improved waveguide bandpass filter that has high rejection of harmonic frequencies and that may be constructed in a convenient mechanical arrangement, readily incorporated into a waveguide integrated package.

SUMMARY OF THE INVENTION

To accomplish the foregoing and other objects, features, and advantages of the invention, there is provided a waveguide bandpass filter that is comprised of alternate sections including alternate ridge waveguide and evanescent waveguide sections. In accordance with the invention, the ridge waveguide sections form resonant cavities. The waveguide restricts the second harmonic to a single mode of transmission in the filter and substantially reduces the number of modes available at higher frequencies. In one embodiment in accordance with the invention, a filter is connected to standard waveguide sections by way of oppositely disposed matching sections which may comprise waveguide of reduced height and/or width. The number of ridge guide resonator sections depends on the filter characteristics required. Each ridge guide resonator section may be of the same cross-sectional dimension or there may be different cross-sectional dimensions. The resonator lengths are preferably on the order of an integral number of half-guide wavelengths at the center frequency, adjusted to allow for the effect of the end coupling to adjacent sections. In an alternate embodiment in accordance with the invention, the cross-section of the coupling waveguide is made equal to the overall dimensions of the ridge guide, thus providing a more simplified filter construction.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a plan view of a preferred embodiment of the waveguide bandpass filter of the present invention;

FIG. 2 is a side cross-sectional view of the filter of FIG. 1;

FIG. 3 is a cross-sectional view taken along line 3—3 of FIG. 1 showing the cross-sectional configuration of the ridge guide section;

FIG. 4 is a cross-sectional view taken along line 4—4 of FIG. 1 showing the cut-off or evanescent guide section;

FIG. 5 is a perspective view partially cut away showing the embodiment of FIGS. 1–4;

DETAILED DESCRIPTION

Figure 6:
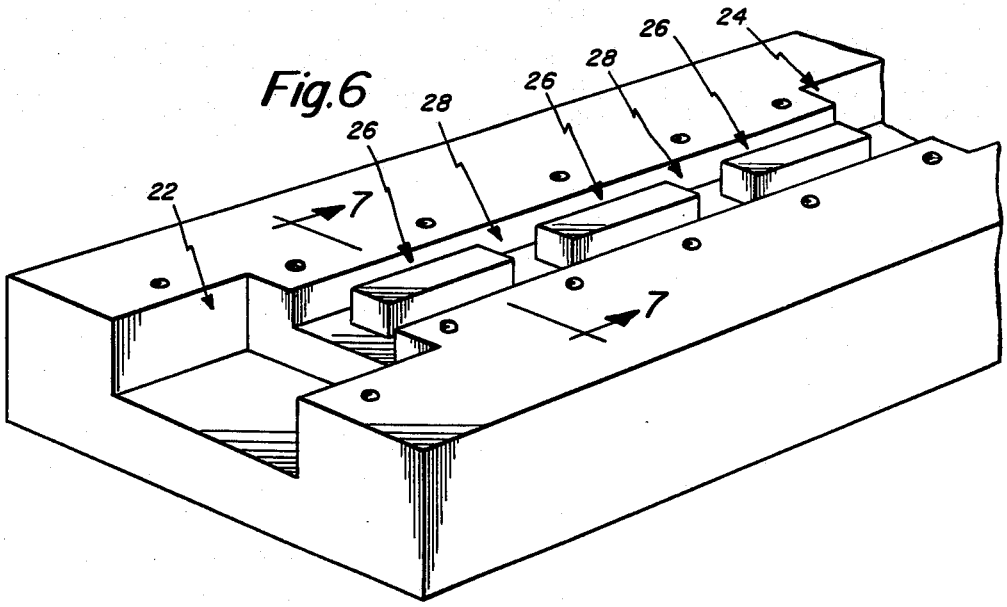
FIG. 6 is a perspective view of an alternate embodiment of the invention in which both ridge and cut off guide sections are of like dimension.

In accordance with the present invention, there is provided a waveguide bandpass filter having high attenuation, not only at adjacent stopband frequencies, but also at harmonics of the pass band. This is all accomplished in accordance with the present invention in a single structure without the requirement for cascading such as with a low pass filter to reject harmonic frequencies. In accordance with the invention, there is provided a waveguide cavity resonator which provides high Q factor, in combination with the control of the second harmonic which is afforded by evanescent waveguide sections. The ridge waveguide/resonant cavity concepts of the invention are carried out by means of a design procedure to be described hereinafter.

One embodiment of the present invention is illustrated in FIGS. 1-5 herein. In this embodiment, there is provided a waveguide bandpass filter that employs resonant cavities of ridge waveguide coupled in combination with sections of evanescent mode waveguide. These different ridge and evanescent waveguide sections are provided in alternating sections as illustrated in the drawing.

In designing the filter illustrated in the drawing the bandpass characteristics are selected by transforming a corresponding LC lumped element lowpass prototype. In this connection, reference is made to FIG. 8 which shows the transformed circuit for the bandpass prototype. In this connection, reference is made to FIG. 9 which shows an equivalent circuit of the bandpass filter of the invention derived using impedance transformers. In the bandpass prototype, it is noted that the requirements of the bandpass characteristic only fix relationships between the various dimensions of the structure, rather than fixing the characteristics absolutely. In other words, there are actually a family of different characteristics and the particular relationships selected from the family are done so to provide the proper filtering. Thus, in addition to meeting the requirements of the bandpass characteristic, dimensions are also chosen to site any spurious pass bands away from the second harmonic of the desired pass band.

In FIGS. 1-5, it is noted that the filter of the invention is considered as being connected to standard waveguide members 10 and 11. The members 10 and 11 may likewise be connected to other waveguide components as part of an overall waveguide integrated package. Alternatively, the members 10 and 11 may be terminated in flanges so that the filter is a separate waveguide component itself.

Adjacent to the standard waveguide members 10 and 11 are respective waveguide matching sections 12 and 13. The sections 12 and 13 are comprised of waveguide of reduced height and/or width. In the particular embodiment shown in FIGS. 1 and 2, the sections 12 and 13 have the same width as the sections 10 and 11 but are of reduced height, as noted in particular in FIG. 2. The matching sections 12 and 13 may be used to optimize the coupling to the resonator sections. However, in most cases, it is possible to adjust the length of the end coupling sections 14 and 15 to compensate for the effect of the step from normal waveguide to coupling section dimensions.

Reference has been made herein to resonator sections and coupling sections. With regard to the embodiment of FIGS. 1-5, there are multiple resonator sections and multiple coupling sections. These are identified as resonator sections 16 and coupling sections 18. In this connection, also refer to FIGS. 8 and 9 and the identification made therein as to the respective resonator and coupling sections 16 and 18. Reference has already been made to the previously noted end coupling sections 14 and 15.

Each of the resonator sections is comprised of a ridge waveguide, which in the embodiment described in FIGS. 1-5 is a single ridge waveguide section. In this regard, reference is made to FIG. 3 which shows a cross-sectional view taken along line 3—3 of FIG. 1 illustrating the ridge guide section at 17.

Each of the coupling sections 18 referred to hereinbefore is comprised of a section of cut-off or evanescent mode waveguide. In this regard, reference is made to the cross-sectional view of FIG. 4 which is taken along line 4—4 of FIG. 1 illustrating the cut-off guide cross-section at 19.

The number of ridge guide resonator sections 16 depends on the filter characteristics that are required. In the embodiment of FIGS. 1-5, all of the ridge guide resonator sections are shown as being of the same cross-section dimension, although, in other designs, the dimensions of each ridge guide resonator section may differ from one to the next. The resonator lengths L1 are to be an integral number of half guide wavelengths at the desired center frequency. The integral number of half guide wavelengths is adjusted to allow for the effect of the coupling sections. In this regard, tuning screws may be used in the resonators to adjust the center frequency.

With regard to the coupling sections 18, the cross-sectional dimensions of these sections are chosen so that the waveguide is cut off at the desired frequency or pass band. This thus provides coupling sections which reactively load the resonator sections and essentially couple the resonator sections together. If the second harmonic can propagate in these coupling sections, it should only do so in one mode, thus enabling the filter response at the second harmonic to be easily predicted.

Figure 7:
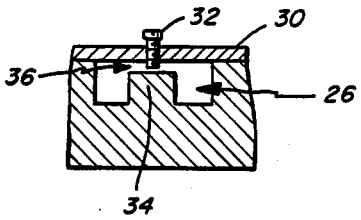
FIG. 7 is a cross-sectional view taken along line 7—7 of FIG. 6.

An alternate embodiment of the invention is illustrated in FIGS. 6 and 7. This is essentially a special case of the waveguide bandpass filter in which the cross-section of the coupling waveguide is made equal to the overall dimensions of the ridge guide and these are maintained uniform throughout the filter as illustrated. Thus, in the embodiment of FIG. 6 there is shown a filter having standard end waveguide sections 22 and 24. The filter itself comprises multiple ridge guide sections 26 with each of the ridge guide sections being intercoupled by means of coupling sections 28. As in the embodiment of FIGS. 1-5, the coupling sections are selected for evanescent mode operation at cut-off and essentially reactively load the resonators and couple them together. However, unlike the embodiment of FIGS. 1-5, it is noted that the overall outer dimensions of both the resonator sections and the coupling sections are the same.

FIG. 7 shows a cross-sectional view taken along line 7—7 of FIG. 6. In the embodiment of FIGS. 6 and 7, the filter is actually a part of a waveguide integrated package incorporating a top lid 30. FIG. 7 illustrates a tuning screw 32 which is disposed in the lid opposite the centers of the resonators. The filter is well suited to this type of construction. Note in FIG. 7 the tuning screw 32 disposed over the waveguide ridge 34 and extending into the resonator cavity 36.

Design Procedure

In accordance with the invention, there is provided for a combination of higher Q factors possible with the use of waveguide cavity resonators along with control of the second harmonic afforded by the use of evanescent waveguide sections. In this connection, reference may be made to FIGS. 8 and 9 which show pertinent equivalent circuits. Also, reference is made to FIG. 10 which shows the frequency response that is typical with a bandpass filter in accordance with the invention.

This design procedure is adapted from the procedure given for waveguide filters in "Microwave Filters, Impedance Matching Networks and Coupling Structures" by Matthaei, Young & Jones, McGraw-Hill 1964 at section 8.06 also using formulae and graphs from "Microwave Filters, Impedance Matching Networks and Coupling Structures" along with the "Microwave Engineers Handbook, Vol. 1", by Artech, 1971 and "Waveguide Handbook" by Marcuvitz, McGraw-Hill 1951. There are also other references that may be employed in carrying out the design procedures in a similar way using alternative formulae and graphs used for the various parameters of the filter. In the design procedure that follows, derivations are set forth for the special case of filter design illustrated in FIGS. 6 and 7 employing uniform dimensions throughout the resonator and coupling sections. However, it is to be understood that these design procedures may be readily extended to the more general case as in the embodiment of FIGS. 1–5 described herein.

Suitable dimensions are assumed for the width a and the height b of the coupling waveguide sections 18. In this regard, note the dimensions a and b in FIG. 4. It may be necessary to modify these dimensions slightly in light of the results of the design procedure. However, dimensions of the waveguide normally used for twice the required center frequency are a good initial approximation.

Figure 10:
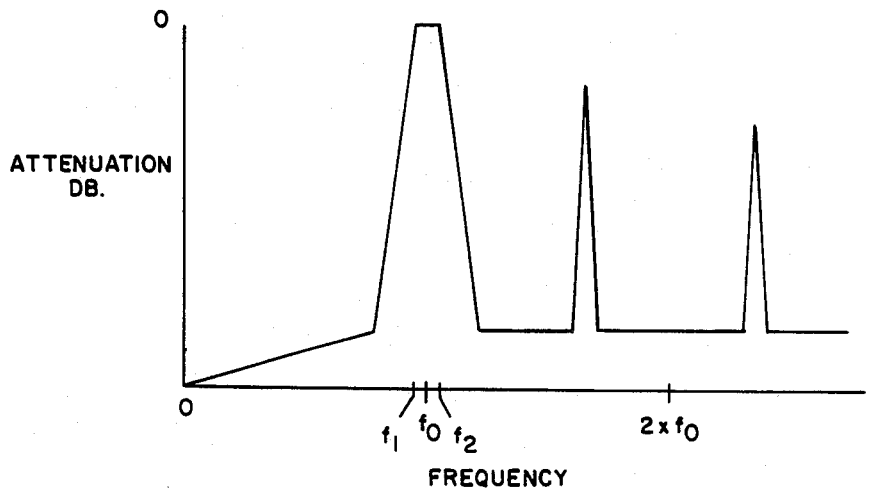
FIG. 10 illustrates a frequency response curve.

Next, the cut-off wavelength ($\lambda_c$) of the ridge guide sections 16 is chosen so that the higher resonant frequencies of the resonators are well away from the second harmonic of the desired frequency. Assuming half wavelength cavities are employed, this is: $\lambda_c = 1.53\ \lambda_o$ where $\lambda_o$ is the free space wavelength at the center frequency ($f_o$). This selection produces a frequency response such as illustrated in FIG. 10 herein.

With regard to the ridge guide sections as illustrated in FIG. 3 herein, the ridge width s and the ridge gap d dimensions may then be selected to provide the desired cut off wavelength. This selection is made using the curves in "Microwave Engineering Handbook", Vol. 1, Artech, 1971, page 87 or formulae and tables found in waveguide handbook by Marcuvitz, McGraw-Hill, 1951, section 8.6.

Figure 8:
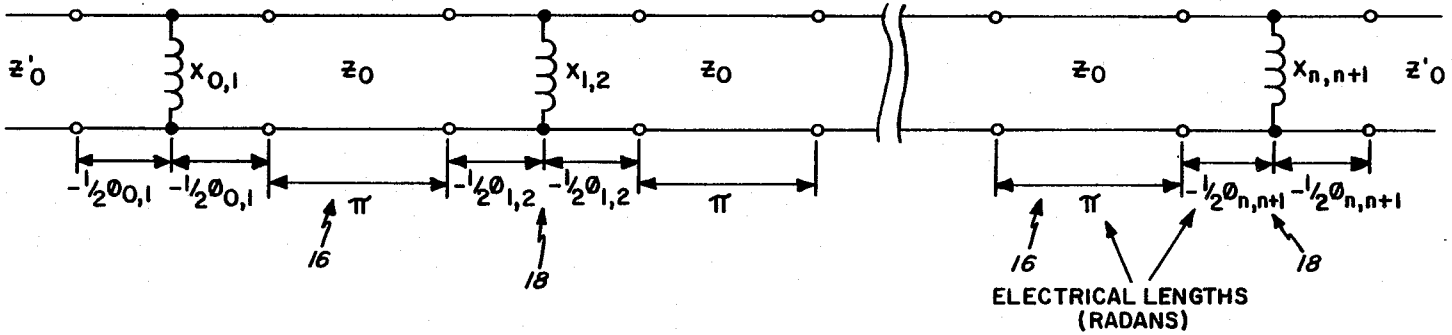
FIG. 8 is an equivalent circuit for a bandpass filter.
Figure 9:
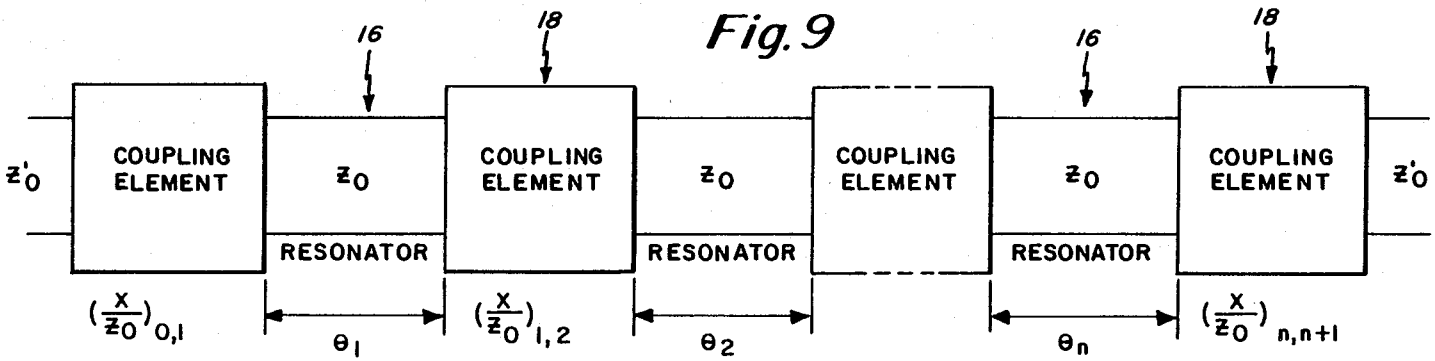
FIG. 9 is an equivalent circuit of the bandpass filter of the invention derived using impedance transformers.

Using this value of cut-off wavelength $\lambda_c$ in place of $2a$, the design procedure of Matthaei, et al, Table 8.06-1 and FIG. 8.06-1 may be followed to give values of $(X/Zo)_{j,j+1}$ and $\theta_j$ for the required bandpass filter response. The equivalent circuit for the resulting filter is shown in FIG. 9, where;

$$\theta_j = \pi - \tfrac{1}{2}(\phi_{j-1,j} + \phi_{j,j+1})$$

radians is the electrical length of the resonator.

The effect of the step from normal (propagating) waveguide dimensions to the filter waveguide dimensions may be approximately by the shunt reactance of a window a×b in a thin iris across the larger waveguide.

$$\text{i.e.}\left(\frac{X}{Zo}\right)_{step} = \frac{4\pi Ma}{a'b'\lambda g'}$$

from Matthaei, et al, FIG. 5.10-5, where a', b', λg' are the dimensions of the normal waveguide and M is given by Matthaei, et al, FIG. 5.10-4(*a*) modified as equation 5.10-3. For values likely to be encountered in the present design procedure, the value $$M = \frac{0.053 + 0.21b/a}{1 - \left(\frac{2a}{\lambda o}\right)^2},$$

as an approximation.

The susceptance required from the end coupling sections is thus $$\frac{B'}{Yo} = -\left(\frac{Zo}{X}\right)_{0,1} + \left(\frac{Zo}{X}\right)_{step}$$

If this susceptance is positive (capacitive), the width (a) of the filter waveguide should be increased and the values recalculated.

The attenuation of evanescent waveguide is given by $$\alpha = \frac{\pi 1}{a}\left(1 - \left(\frac{2a}{\lambda o}\right)^2\right)^{\frac{1}{2}} \text{ nepers}$$

and the equivalent susceptance is $$\frac{B}{Yo} = -2(e^{2\alpha} - 1)^{\frac{1}{2}}$$

Thus one can derive the length needed for a given susceptance as $$1 = \frac{a}{2\pi}\ \frac{\log_e\left(1 + \left(\frac{B}{2Yo}\right)^2\right)}{\left(1 - \left(\frac{2a}{\lambda o}\right)^2\right)^{\frac{1}{2}}}$$

By inserting the values of $$\left(\frac{B}{Yo}\right)_{j,j+1} = -\left(\frac{Zo}{X}\right)_{j,j+1}$$

into this equation, one can calculate the lengths of the coupling sections. The lengths of the resonator sections is given by $$1r = \frac{\lambda g}{2\pi} \cdot \theta;$$

For the more general embodiment of the filter, the dimensions a, b, and $\lambda_g$ will be those pertaining to the particular section whose length is being calculated.

In connection with the above-equations relating to the evanescent waveguide, it is noted that the evanescent waveguide has been approximated by the equivalent circuit of the shunt inductance. In this connection, refer to FIGS. 8 and 9. There may have to be some very small empirical adjustments to the dimensions calculated in order to provide the required filter response.

The following is an example of typical parameters of a waveguide bandpass filter constructed in accordance with the present invention:

| | |
|---|---|
| Center frequency | 17.75 GHz |
| Bandwidth | 2.2% |
| Number of resonators | 3 |
| Passband loss | −0.8 dB |
| Passband return loss | −20 dB |
| Attenuation 19.4–27 GHz | −50 dB |
| Attenuation 33–37 GHz | −40 dB |

I claim:

1. A waveguide bandpass filter comprising; multiple waveguide sections including alternating ridge waveguide sections and evanescent waveguide sections, each said ridge waveguide section defining a resonant cavity and comprising at least a single ridge waveguide section having the ridge extending from the waveguide broad wall, said evanescent waveguide section reactively loading said resonant cavity thus intercoupling said ridge waveguide sections to provide a low loss filter having high attenuation not only at adjacent stop band frequencies but also at harmonics of the pass band.

2. A waveguide bandpass filter as set forth in claim 1 wherein the length of each resonant cavity is on the order of one-half guide wavelength at the center operating frequency.

3. A waveguide bandpass filter as set forth in claim 1 including tuning means associated with each resonant cavity.

4. A waveguide bandpass filter as set forth in claim 3 wherein said tuning means comprises a tuning screw for adjusting the center frequency.

5. A waveguide bandpass filter as set forth in claim 1 wherein the outer dimensions of the ridge waveguide section are different than that of the evanescent waveguide section.

6. A waveguide bandpass filter as set forth in claim 5 wherein the evanescent waveguide section is of smaller cross-sectional dimension than that of the ridge waveguide section.

7. A waveguide bandpass filter as set forth in claim 1 wherein the outer dimensions of the ridge waveguide section are substantially the same as that of the evanescent waveguide section.

8. A wave guide band pass filter as set forth in claim 1 wherein the lengths of the resonator sections is given by:

$$1r = \frac{\lambda g}{2\pi} \cdot \theta;$$

where $\lambda_g$ = *guide wavelength*, $\theta_j = \pi - \frac{1}{2}(\phi_{j-1,j} + \phi_{j,j+1})$, $\phi$ = effective electrical length of the equivalent circuit of the evanescent waveguide coupling section.

9. A waveguide bandpass filter as set forth in claim 8 wherein the length of the evanescent waveguide section is given by:

$$1 = \frac{a}{2\pi} \frac{\log_e\left(1 + \left(\frac{B}{2Yo}\right)^2\right)}{\left(1 - \left(\frac{2a}{\lambda o}\right)^2\right)^{\frac{1}{2}}}$$

where $$\frac{B}{Yo} = -\frac{Zo}{X}, \text{ and}$$

$$\frac{\pi 1}{a}\left(1 - \left(\frac{2a}{\lambda o}\right)^2\right)^{\frac{1}{2}} \text{ nepers} = \text{attenuation of the evanescent waveguide,}$$

B = the equivalent shunt susceptance of the evanescent waveguide coupling section, Yo = the characteristic admittance of the ridge waveguide section, X = the equivalent shunt reactance of the evanescent waveguide coupling section, Zo = the characteristic impedance of the ridge waveguide section, and a = the broad wall dimension of the evanescent waveguide section in the same units as $\lambda o$ (free space wavelength).

10. A waveguide bandpass filter as set forth in claim 1 including standard waveguide members at each end of the filter.

11. A waveguide bandpass filter as set forth in claim 10 including waveguide matching sections coupling each standard waveguide member to the alternating ridge and evanescent waveguide sections.

12. A waveguide bandpass filter as set forth in claim 11 wherein the waveguide matching sections couple to the ridge waveguide sections at either end of the filter.

* * * * *